US005970635A

United States Patent [19]

Wilmoth

[11] Patent Number: 5,970,635

[45] Date of Patent: Oct. 26, 1999

[54] JET AGITATION DREDGING SYSTEM

[76] Inventor: Daryl Wilmoth, 1070 NW. 6th Ave., Boca Raton, Fla. 33432

[21] Appl. No.: 09/015,865

[22] Filed: Jan. 29, 1998

[51] Int. Cl.[6] ..... E02F 5/02

[52] U.S. Cl. ..... 37/323; 37/333

[58] Field of Search ..... 37/323, 317, 320, 37/321, 322, 333

[56] References Cited

U.S. PATENT DOCUMENTS

| | | | |
|---|---|---|---|
| 1,168,293 | 1/1916 | Emmons | 37/323 X |
| 3,412,862 | 11/1968 | Chaplin | 37/323 X |
| 3,521,386 | 7/1970 | Francklyn | 37/323 X |
| 3,624,932 | 12/1971 | Doyle | 37/323 X |
| 3,673,716 | 7/1972 | Trondle . | |
| 3,783,535 | 1/1974 | Hanks | 37/323 X |
| 3,862,502 | 1/1975 | Young | 37/323 X |
| 4,018,483 | 4/1977 | Smith . | |
| 4,033,470 | 7/1977 | Venus et al. . | |
| 4,253,255 | 3/1981 | Durell . | |
| 4,276,846 | 7/1981 | Anderson . | |
| 4,295,757 | 10/1981 | Gaspar . | |
| 4,352,251 | 10/1982 | Sloan . | |
| 4,575,280 | 3/1986 | Hemphill et al. . | |
| 4,586,853 | 5/1986 | Sweeney et al. . | |
| 4,604,000 | 8/1986 | van Weezenbeck . | |
| 4,628,623 | 12/1986 | Deal | 37/323 X |
| 4,681,372 | 7/1987 | McClure . | |
| 4,889,391 | 12/1989 | Cornelius . | |
| 4,946,597 | 8/1990 | Sury . | |
| 5,487,229 | 1/1996 | Nathenson et al. | 37/323 X |
| 5,546,682 | 8/1996 | Skerry | 37/323 X |
| 5,647,691 | 7/1997 | Wirth | 37/323 X |
| 5,659,983 | 8/1997 | Coutarel et al. | 37/323 X |

FOREIGN PATENT DOCUMENTS 595291 12/1947 United Kingdom .

OTHER PUBLICATIONS

Water Injection Dredging by p/a HAM, International Dredging Contractors, Jan. 1992.

*Primary Examiner*—Christopher J. Novosad
*Attorney, Agent, or Firm*—Quarles & Brady

[57] ABSTRACT

A dredging system for removing material from a submerged ground surface includes a dredge head housing having an enclosed, pressurized agitation chamber into which the material to be removed is received from an intake opening. Connected to the housing is a feed line that supplies pressurized fluid, such as water, air or both, to a fluid manifold connected to the housing and within the agitation chamber. The fluid manifold contains cutting outlets for discharging the pressurized fluid onto the material to liquefy the material and lifting outlets for discharging the pressurized fluid so as to urge the liquefied material towards a riser chute. The riser chute is connected to a top cover of the housing and extends above the housing and upwardly discharges the liquefied material into the water column of the body of water.

17 Claims, 4 Drawing Sheets

JET AGITATION DREDGING SYSTEM

CROSS-REFERENCE TO RELATED APPLICATION

Not Applicable

STATEMENT REGARDING FEDERALLY SPONSORED RESEARCH AND DEVELOPMENT

Not Applicable

BACKGROUND OF THE INVENTION

1. Field of the Invention

The invention relates to waterway channel maintenance. More specifically, the invention relates to channel dredging, particularly channel side dredging.

2. Description of the Prior Art

Shoaling and the buildup of silt and mud are common problems around docks, ports and channels, and frequent dredging is required to maintain sufficient depth of water for use by ships, barge and other waterborne vehicles. Many types of dredge equipment have been developed, including cutter-head dredges, bucket or shovel dredges, and side trailing hopper dredges. These dredge systems use mechanical manipulation of the dredged material, either by pumping or scooping, to transfer the material away from the area being dredged, e.g. a dock or channel side. An example of a dredging system using pumping is disclosed in U.S. Pat. No. 4,352,251. This reference discloses a hand operated suction dredge head and a hydraulic submersible pump assembly. Water and sludge is driven through a conduit and pump and is discharged to a location remove from the dredge head. While these systems are somewhat effective in dredging level surfaces, the angularity of channel sidewalls can present challenges to the operation of certain types of these dredges.

Another problem present with prior dredge systems is that they are destructive to bottom dwelling creatures because of the mechanical action of the dredging. Also associated with mechanical dredging systems is the problem of finding a location for the dredged material after it has been removed. Very often the ship from which the dredging is taking place must act as a temporary storage area for the removed material. This necessitates a larger ship size than otherwise needed, thereby requiring more crew and a higher United States Coast Guard license rating to operate the vessel. An additional special problem with systems that transfer material by pumping is that the slurry dredged up and pumped through the pumps is very abrasive. This abrasiveness causes the pumps to wear at a higher rate than pumps just pumping water.

A more recent system, referred to as water injection dredging (WID), has shown advantages in dredging channel side buildup. Generally, WID involves injecting water into the material, liquefying it and causing it to flow under its own weight to deeper adjacent water. An example of WID is disclosed in U.S. Pat. No. 4,604,000. While this technique can be useful for higher level side dredging, it is largely ineffective for bottom dredging where there is no lower runoff level.

Another problem associated with both WID and mechanical dredging systems is that they produce a layer of "fluff" or low density mixture of bottom material and water just above the dredged bottom. When survey equipment tries to measure the depth of the bottom the depth recording equipment records the fluff layer rather than the true dredged bottom.

SUMMARY OF THE INVENTION

It is therefore an object of the invention to provide a dredging system that can return dredged material back into the water column where it can be carried away by currents and be allowed to settle out in areas far away from the dredged area.

It is another object of the invention to provide a dredging system that minimizes the creation of fluff that interferes with accurate measurement of the true depth of the dredged bottom.

It is a further object of the invention to provide a dredging system that does not require dredged material to be brought on board the dredging ship, thereby allowing use of smaller ship sizes.

It is still another object of the invention to provide a dredging system that does not excessively wear pumps used in the dredging operations by exposing the pumps to abrasive material.

It is still a further object of the invention to provide a dredging system that does not mechanically work the dredged material so as to be less destructive to bottom-dwelling creatures.

These and other objects of the invention are achieved by a dredging system for removing material from submerged ground surfaces, such as the bottom or sides of a water channel. The system includes a dredge head housing having a pair of preferably substantially parallel side walls, a tail piece and a top cover. The housing defines an agitation chamber into which material is received from an intake opening between the front ends of the side walls and top cover.

A feed line connects to the housing and supplies pressurized fluid, such as water, to a fluid manifold connected to the housing and within the agitation chamber. The fluid manifold contains cutting outlets for discharging the pressurized fluid onto the material to liquefy the material. The fluid manifold also includes lifting outlets for discharging the pressurized fluid so as to urge the liquefied material towards a riser chute. The riser chute extends from a discharge opening in a top cover of the housing and extends above the housing and upwardly discharges the liquefied material into the water column.

According to a further aspect of the invention, evenly-spaced cutting outlets are positioned above and adjacent the intake opening. These cutting outlets are oriented to spray the pressurized fluid downward onto the incoming material across the entire width of the intake opening to liquefy the material.

Additional, preferably evenly-spaced, cutting outlets can also be positioned adjacent both side wall leading edges and oriented to spray the pressurized fluid in front of the side wall leading edges. The cutting jets effectively create a channel for each side wall, reducing the drag created by towing the dredge head housing through the material and allowing the dredge head to track better through the material.

According to another aspect of the invention, the fluid manifold extends along both side walls and contains further cutting outlets and/or lifting outlets. The additional jets of fluid pressurize the chamber and contribute to the agitation and liquification of the incoming material to facilitate discharge through the chute into the vertical column above. The cutting outlets are oriented to spray the pressurized fluid laterally into the agitation chamber, and the lifting outlets are oriented to spray the pressurized fluid towards the discharge chute. A lift outlet may also be positioned adjacent the discharge opening and oriented to spray the pressurized fluid into the riser chute.

According to still another aspect of the invention, the tail piece is preferably hinged to a trailing edge of the top cover. The tail piece may also include a tail piece weight attached to the tail piece adjacent the tail piece bottom edge to urge the tail piece bottom edge to contact the bottom of the body of water. The housing may also include a front seal plate hingedly connect to a top cover leading edge.

According to a further aspect of the invention, the feed line and fluid manifold also receive a pressurized gas and liquid mixture and the fluid manifold provides outlets for injecting the gas and liquid mixture into the agitation chamber.

The system also preferably includes an articulated coupling that permits angling of the dredge head relative to the feed line. With such construction, the dredge head can be utilized to dredge not only horizontal surfaces such as channel bottoms but also angled surfaces typically encountered in channel sides.

Thus, the invention provides a dredging system that is capable of removing material from a variety of submerged surface environments while avoiding or reducing many of the drawbacks suffered with prior systems. Further details of the system are set forth in the following detailed description.

BRIEF DESCRIPTION OF THE DRAWINGS

A further understanding of the invention can be gained from a review of the following detailed description together with the accompanying drawings, wherein.

DETAILED DESCRIPTION OF PREFERRED EMBODIMENTS

Figure 1:
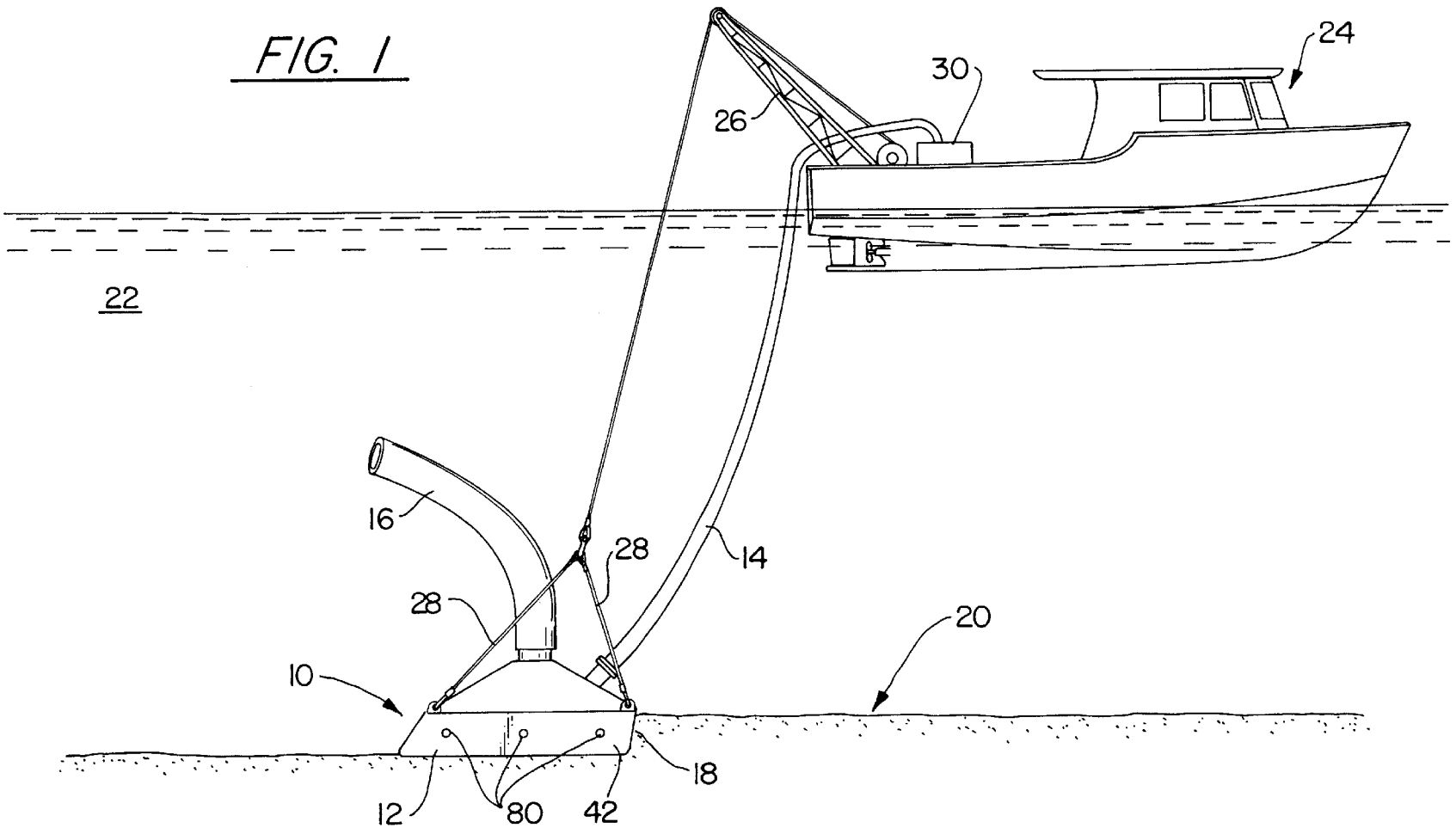
FIG. 1 is a view of a dredging system according to the invention being operated from a dredging vessel.

FIG. 1 illustrates an exemplary dredging system according to the invention. The system 10 includes a dredge head housing 12, and attached to the housing 12 are lift lines, a feed and tow line 14, and a riser chute 16. The dredge head housing 12 removes material 18 from a submerged ground surface such as the bottom of a channel 20 and injects the material out of the riser chute 16 into the water column 22 above the dredge head housing 12. The system 10 is supported by a vessel 24, which can include a tug, and in any event can be a smaller class vehicle than used with prior dredging systems in view of the reduced pumping and material storage requirements of the inventive system. The support system can include a lift boom 26 supporting lift lines 28 to control the depth of the dredge head housing 12. The dredge head housing 12 can be propelled by the feed and tow line 14 extending from the housing 12 to the vessel 24. The feed and tow line 14 can be constructed using steel tubing or reinforced hose capable of operating under tensile forces in towing the dredge head housing 12. The dredge head housing 12 is supplied with pressurized fluid, that can include water, air or both through the line 14 from a suitable pumping system 30 on board the vessel 24. The dredge head housing 12 could alternatively be pulled by tow lines separate from a feed line 14. In embodiments supplying both air and water, the feed line 14 can provide either a single conduit through which both air and water are supplied or separate, bundled lines can be provided to transport the air and water separately to the dredge head housing 12.

Figure 2:
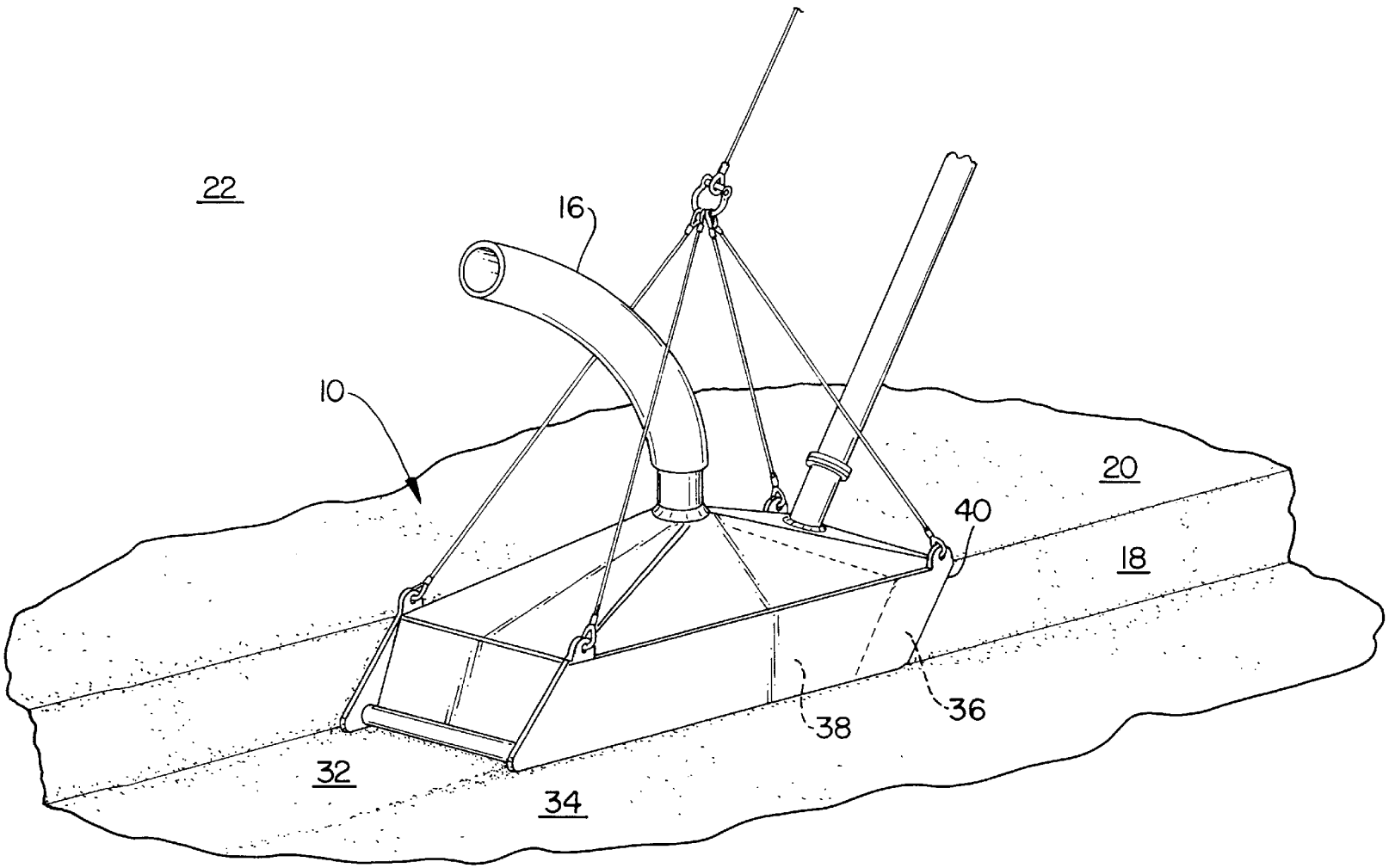
FIG. 2 is a perspective view of a dredge head according to the invention in operation.

The dredge system 10 is used to transport a variety of ground surface materials including silt and particularly compact mud. FIG. 2 illustrates a dredge head system 10 according to the invention, forming a dredge line 32 in the channel 20 next to a previously dredged line 34. As the housing 12 is dragged through the material 18, a section of the material, referred to as a "cake" 36 enters an agitation chamber 38 formed within the housing though an intake opening 40. The incoming material 36 is fluidized within the chamber 38 and exhausted under pressure through the chute 16 for displacement in the water column 22 above.

Figure 4:
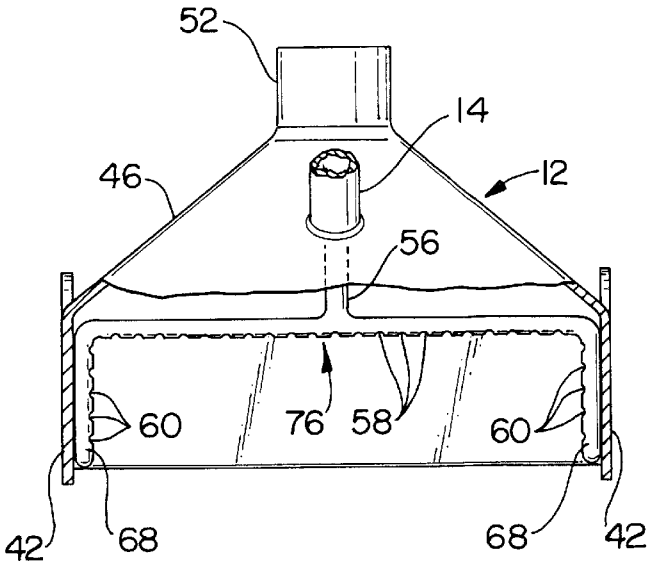
FIG. 4 is a front elevation of the dredge head.
Figure 3:
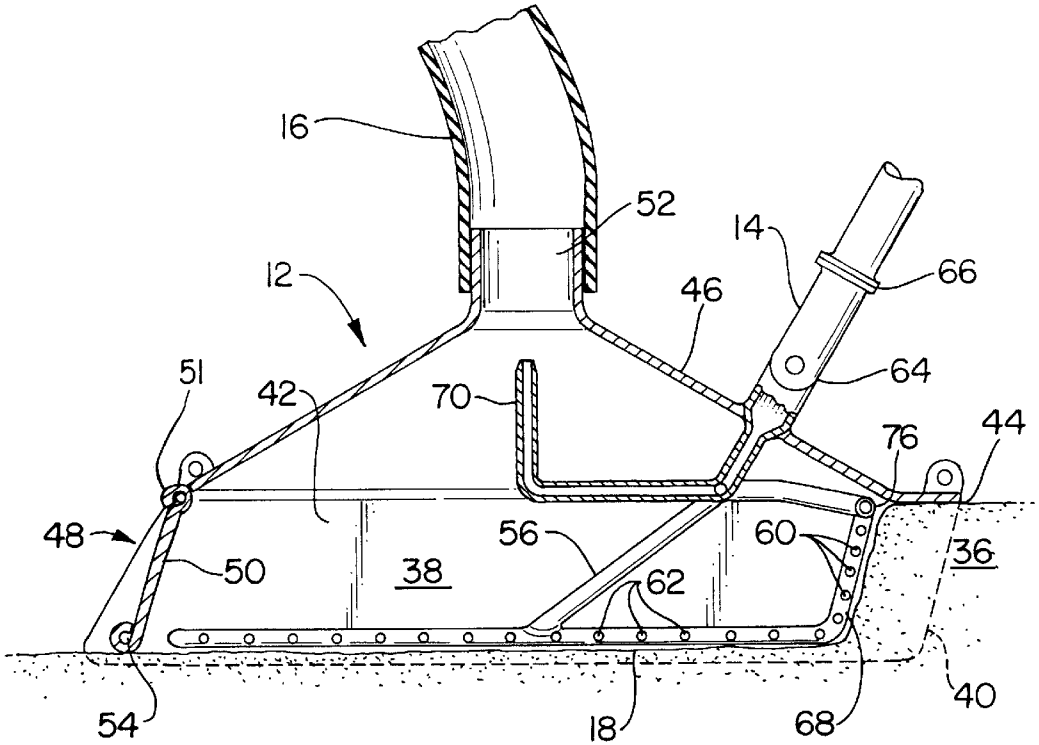
FIG. 3 is a sectional side view of the dredge head.

Referring to FIGS. 3 and 4 together, the intake opening 40 is bounded by two preferably parallel side walls 42, the ground surface of material 18, and the leading edge 44 of the top cover 46. The rear opening 48 between the side walls 42 is closed by a tail piece 50. The agitation chamber 38 is sealed on both sides by the side walls 42, sealed in the rear by the tail piece 50, and sealed in the front by a combination of the cake of material 36 and the leading edge 44 of the top cover 46. The top of the agitation chamber 38 is sealed by the top cover 46 except for a discharge opening 52 leading to a riser chute 16.

The bottom of the agitation chamber 38 may be sealed by a bottom plate (not shown) spanning between the side walls and the tail piece, or in a presently preferred embodiment, by the ground surface 18. The preferably open bottom as shown enables the dredge head housing 12 to more easily dig into a material cake 36, even when the cake has a height that is higher than the dredge head housing.

The tail piece 50 is preferably hinged with hinge 51 to the trailing edge of the top cover 46. Advantageously, this construction allows the tail piece 50 to maintain contact with the material 18 even when the top surface of the material 18 is undulating with respect to the top cover 46. To further that purpose, a tail piece weight 54 can be added to the tail piece 50 adjacent the bottom edge of the tail piece 50 to urge the bottom edge of the tail piece 50 to contact the top surface of the material 18.

Connected preferably to the interior of the housing 12 is a fluid manifold 56. The fluid manifold 56 contains a pressurized fluid, preferably water, received from the feed line 14 and injects the water through outlets 58, 60, 62 in jets into the agitation chamber 38. The pressurized fluid has two primary functions. The first function is to liquefy the cake of material 36, and the second function of the pressurized fluid is to pressurize the chamber 38 and urge the liquefied material into the riser chute 16. The cutting and pressurization functions of the manifold 56 can further be enhanced by the supply of air that is mixed with the water or supplied through a parallel manifold system (not shown).

The line 14 can be connected to the manifold 56 in a manner that permits angled movement of the dredge head housing 12 relative to the line 14. An articulated coupling can include a pivot 64 to permit forward and rearward pitch of the housing 12, thereby permitting variation due to irregularities in the ground surface 18. The coupling can further include a swivel 66 to permit side to side roll, which is effective in enabling the dredge head housing 12 to be used on side angled surfaces commonly found along channel sides.

To liquefy the cake of material 36, the cutter outlets 58, 60 are disposed on the fluid manifold 56 and oriented so as to direct the pressurized fluid onto the cake of material 36 entering into the agitation chamber 38. When pressurized fluid is directed onto the material 36, the material is loosened, fluidized, and then displaced. In the presently preferred embodiment of the invention, a row of evenly-spaced cutter outlets 58 are disposed on a portion of the fluid manifold 56 positioned adjacent the top edge 64 of the intake opening 40 and oriented downward onto the incoming cake of material 36. It should be understood, however, that any location and/or orientation of the cutter outlets 58 are acceptable so long as the cutter outlets 58 are directed onto the incoming cake of material 18. An additional embodiment of the invention includes legs 68 of the fluid manifold 56 positioned adjacent the leading edge of each side wall 42. Upon these legs 68 are disposed a row of evenly-spaced cutter outlets 60 oriented to laterally spray the pressurized fluid. This lateral spray of pressurized fluid further liquefies the incoming material 18.

The action of injecting pressurized fluid into the substantially sealed agitation chamber 38 creates a pressure differential between the fluid contained within the agitation chamber 38 and the water outside the housing 12. Also, because the agitation chamber 38 is connected to the outside water through the riser chute 16, the pressurized fluid in the agitation chamber 38 will flow from the agitation chamber 38, up the riser chute 16, and into the water column above the housing 12.

Lift outlets 62 disposed on the fluid manifold can also be used to urge the liquefied material from the agitation chamber 38 into the riser chute 16. One way the lift outlets 62 do so is by introducing additional pressurized fluid into the agitation chamber 38. This further increases the pressure differential. Also, the lift outlets 62 are directed toward discharge opening 52 which then creates a current of pressurized fluid that transports liquefied material into the riser chute 16. An alternative embodiment of the invention includes a discharge opening lift outlet 70 on the fluid manifold 56 centrally positioned and facing within the discharge opening 52. The discharge opening lift outlet 70 is oriented to inject pressurized fluid into the riser chute 16.

The discharge of the agitated, liquefied material out of the riser chute 16 takes advantage of the existing currents in the waterway to carry the material away from the dredged area. In the preferred arrangement of trailing the dredge head behind the stern of the support boat (see FIG. 1), the "quick water" of the boat propellers can further assist in agitating and distributing the discharged material. The discharge of the riser chute 16 can alternatively be routed through appropriate pumping to a material collection vessel, such as a barge trailing the support boat and dredge head housing (not shown).

The liquefied material is ejected from a top opening in the riser chute 16. Significantly, by ejecting the liquefied material into the water column a distance above the housing, the liquefied material can be carried farther by the natural action of the water (e.g. river flow, currents, tides, etc.). Thus, the liquefied material can be carried into deeper water located relatively far away from the area being dredged. In the distant water, material will later settle out. This broad range transfer process allows dredging in areas that are locally the deepest area and would otherwise be the natural settling point for liquefied material.

This transfer process also reduces the generation of "fluff." Fluff refers to suspension of ground material, such as mud and silt, directly above the compact ground surface in a less dense mixture with water. Fluff can interfere with depth measurements by signaling a false ground position to detecting equipment. This fluff is typically created by dredging operations that break up the ground substantially in the dredged area during the dredging process. By exhausting the dredged material substantially completely away from the dredged area, the present invention reduces or eliminates fluff.

The presently preferred riser chute includes just one chute. However, more than one chute or pipe may be used to eject the liquefied material into the water column above the housing. Because of drag on the riser chute, the housing is urged downward into the material. This allows for a better seal of the agitation chamber. The riser chute may or may not be slightly angled backwards from the discharge opening to the top chute opening. This angling has the effect of reducing drag as the housing is dragged forward.

As shown particularly in FIG. 4, a plurality of evenly-spaced front cutter outlets 60 are disposed on portions of the fluid manifold positioned adjacent the leading edges of both side walls 42. The front cutter outlets 60 are oriented to spray pressurized fluid directly in front of the leading edges of the side walls 42. In doing so, the material directly in front of the leading edges of the side walls 42 is fluidized and a channel is created in the material. This channel allows the housing 12 to be dragged through the material with less drag. Also, the channel allows the housing 12 to track better through the material.

Figure 5:
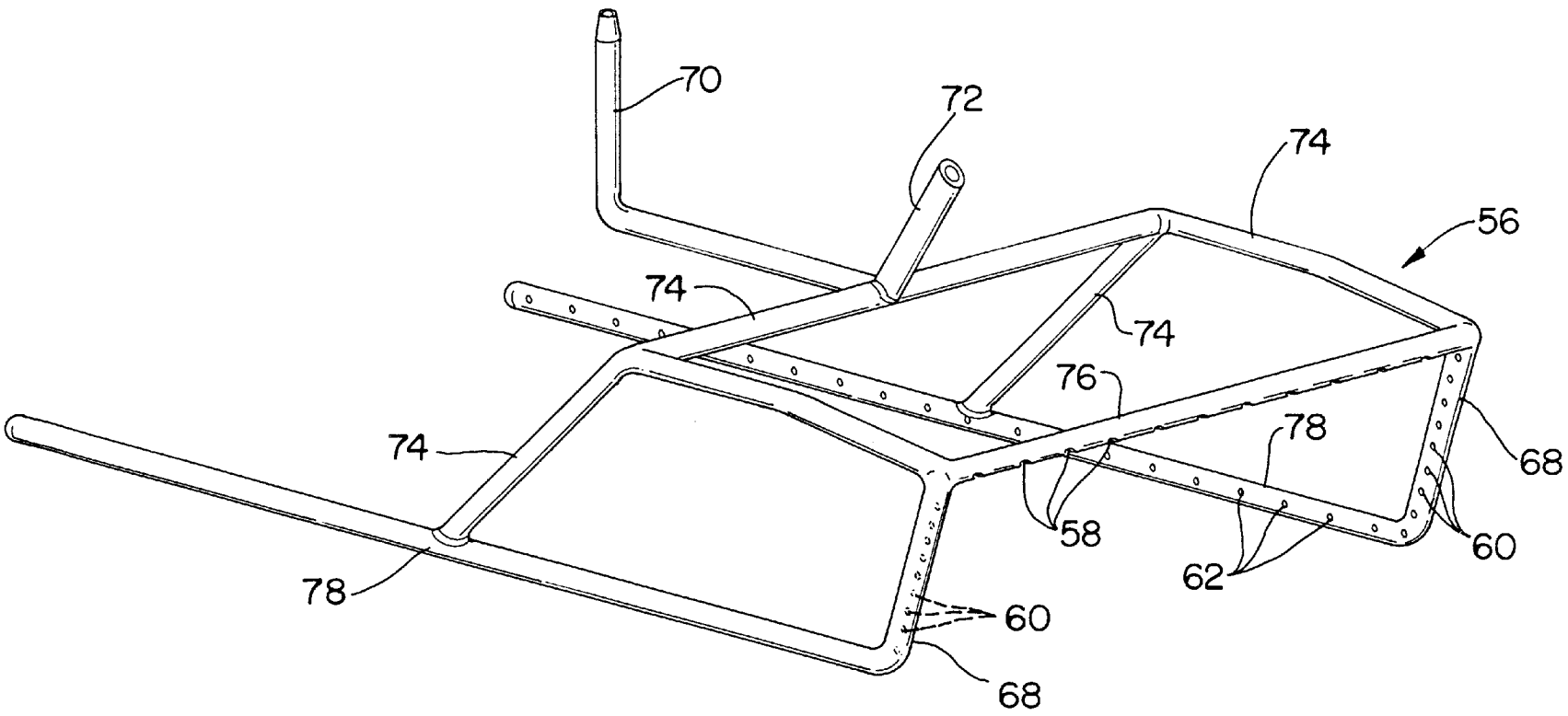
FIG. 5 is an exemplary fluid manifold for use in the dredge head housing.

Referring to FIG. 5, an embodiment of a manifold for use in connection with the dredge head system of the invention is shown, separate from the associated dredge head housing. The manifold 56 includes an intake conduit 72 for receipt of air and/or water from the feed line 14 (FIG. 1). The intake conduit 72 mergers with transfer conduits 74 for transport of water and/or air to the side legs 68, a top span 76 and bottom legs 78 for release through cutter outlets 58, 60 and 62. The discharge opening lifting outlet 70 is also connected centrally along the initial transfer conduit 74. The manifold 56 can be constructed using tubular steel or other material that is then mounted within the housing. Alternatively and preferably, the various conduits can be welded as half rounds, for example, to the adjacent surfaces of the dredge head housing, particularly along the legs providing cutting and lifting outlets.

Referring again to FIG. 1, the side walls of the housing 12 can be semi-permanently connected, with bolts through bolt holes 80 for example, to similar dredge head housings to provide wider material dredging in ganged fashion. This gang mounting of the housings allows for more material to be dredged in a single pass of the housings through the material.

The dredge head housing 12 can be constructed of a suitably strong and durable material such as steel and fabricated from welded components. The dredge head housing 12 can be dimensioned to a width and depth of about 10 feet with a height of 4 feet. The riser pipe or tube can have a length of 8 to 10 feet. Other dimensions to meet the particular circumstances can also be used.

Although preferences for the construction of embodiments of the invention have been described with a relatively high degree of detail. It should be understood that the scope of the invention is not to be limited by such examples, but rather by a proper interpretation of the following claims.

What is claimed is:

1. A system for dredging material from a ground surface below a body of water, comprising:

a dredge head housing having a pair of spaced side walls, a tail piece extending between rear ends of the side walls and a top cover extending between top edges of the side walls, thereby forming an enclosed agitation chamber having an open bottom opposite the top cover and an intake opening opposite the tail piece for receiving material from the ground surface into the agitation chamber, thereby forming a dredge line in the ground surface;

a feed line connected to and extending away from said housing for supplying a pressurized fluid;

a fluid manifold within and connected to said housing and fluidly connected to said feed line for receiving the pressurized fluid, said manifold comprising a plurality of cutting outlets for injecting the pressurized fluid onto material in front of and entering the intake opening, thereby liquefying the material into an agitated mixture;

said top cover defining a discharge opening for exhaust of the agitated mixture, said manifold including at least one upwardly-directed lift outlet for discharging pressurized fluid to urge the agitated mixture towards and into said discharge opening; and a riser chute connected to and extending upward from said discharge opening to a free end of said riser chute, said free end having a chute opening, whereby said riser chute directs the liquefied material upward and into the body of water for transfer away from the dredge line.

2. A system as recited in claim 1, wherein said plurality of cutting outlets includes evenly-spaced cutting outlets positioned above, across and adjacent said intake opening and oriented to spray the pressurized fluid downward onto the material entering said agitation chamber from said intake opening.

3. A system as recited in claim 2, wherein said plurality of cutting outlets include evenly-spaced cutting outlets positioned adjacent side wall bottom edges and oriented to spray the pressurized fluid laterally into said agitation chamber.

4. A system as recited in claim 1, wherein said feed line and said fluid manifold also receive a pressurized gas and liquid mixture and said fluid manifold provides outlets for injecting the gas and liquid mixture into said agitation chamber.

5. A system as recited in claim 1, wherein said plurality of cutting outlets includes evenly-spaced front cutting outlets positioned adjacent leading edges of both side walls and oriented forward to spray the pressurized fluid onto the material forward of said side wall leading edges.

6. A system as recited in claim 1, wherein spacing between the side walls is open along the bottom of the side walls.

7. A system as recited in claim 1, wherein a tail piece top edge is connected to a top cover trailing edge with a rear hinge, said rear hinge defining a rear pivot axis about which said tail piece pivots, said tail piece being biased to close a rear opening between the side walls but pivoting to allow passage of undischargeable objects.

8. A system as recited in claim 7, further comprising a tail piece weight attached to said tail piece adjacent a tail piece bottom edge to urge the tail piece to a position closing the rear opening.

9. A system as recited in claim 1, wherein said manifold includes evenly-spaced lift outlets positioned adjacent side wall bottom edges and oriented to spray the pressurized fluid towards said discharge opening.

10. A system as recited in claim 9, wherein said lift outlets include a lift outlet positioned adjacent said discharge opening and oriented to spray the pressurized fluid into said riser chute.

11. A system as recited in claim 1, wherein said top cover tapers upwardly from said side walls towards said discharge opening and wherein said top cover tapers upwardly from a top cover trailing edge and a top cover leading edge towards said discharge opening whereby said top cover acts to funnel the liquefied material to said discharge opening.

12. A system as recited in claim 1, further including a plurality of lift lines for positioning said housing in relation to the ground surface.

13. A system as recited in claim 1, wherein said dredge head housing has connecting means for ganging with another dredge head housing.

14. A system as recited in claim 1, wherein said feed line is pivotally connected to said housing, thereby allowing an angle of articulation between said feed line and said housing to vary.

15. A system as recited in claim 1, wherein said riser chute is angled rearward from said discharge opening in said housing to a top opening in said riser chute.

16. A system as recited in claim 1, wherein the side walls are substantially parallel.

17. A dredging system for removing material from a bottom of a body of water, comprising:

a dredge head housing having two spaced and substantially parallel side walls joined by a top cover spanning between top edges of said side walls; spacing between said side walls being open and defining an agitation chamber for material received into said chamber from an intake opening of said housing; a moveable tail piece biased downwardly to close a rear opening between said side walls;

a feed line for supplying pressurized fluid to said housing;

a fluid manifold connected to said housing for receiving the pressurized fluid from said feed line and having a plurality of equally evenly spaced outlets along a front edge of said top cover adjacent said intake opening and oriented to spray jets of the pressurized fluid downward onto a cake of material introduced into said housing, said manifold also having a plurality of evenly spaced side outlets along front edges of the side walls, some of said side outlets being oriented to spray the jets of fluid in front of said housing into the incoming cake of material, others of said side outlets being oriented to spray laterally into said intake opening;

a riser chute fluidly connected to said top cover and extending upward from said top cover, said riser chute receiving liquefied material from said agitation chamber and directing the liquefied material upward and into the body of water.

* * * * *